US006280049B1

(12) United States Patent
Tam

(10) Patent No.: US 6,280,049 B1
(45) Date of Patent: Aug. 28, 2001

(54) COMBINED LANTERN AND INTERMITTENT SIGNALLING LIGHT DEVICE

(75) Inventor: Pui Yin Tam, Hong Kong (HK)

(73) Assignee: Tamplus Company, Ltd. (HK)

( * ) Notice: Subject to any disclaimer, the term of this patent is extended or adjusted under 35 U.S.C. 154(b) by 0 days.

(21) Appl. No.: 09/457,382

(22) Filed: Dec. 9, 1999

(30) Foreign Application Priority Data

Dec. 10, 1998 (GB) ..... 9827257

(51) Int. Cl.[7] ..... F21V 25/00

(52) U.S. Cl. ..... 362/158; 362/228; 362/276; 362/802

(58) Field of Search ..... 362/158, 228, 362/276, 806, 477

(56) References Cited

U.S. PATENT DOCUMENTS 4,763,126 * 8/1988 Jawetz ..... 340/985
5,299,107 * 3/1994 Ratcliffe et al. ..... 362/158
5,400,008 * 3/1995 Toohey ..... 340/321
5,622,422 * 4/1997 Rodgers ..... 362/158
5,800,044 * 9/1998 Marshall ..... 362/158
5,903,212 * 5/1999 Rodgers ..... 340/309.15
6,086,218 * 7/2000 Robertson ..... 362/157

* cited by examiner

*Primary Examiner*—Alan Cariaso
*Assistant Examiner*—Ronald E. DelGizzi
(74) *Attorney, Agent, or Firm*—Leydig, Voit & Mayer, Ltd.

(57) ABSTRACT

A rescue signalling device includes a waterproof buoyant body having a front end and a rear end and a compartment for accommodating a battery to provide a center of gravity for the body to float in water in a substantially upright neutral position with the front end pointing upwards. The device includes a first light source within the front end for energization by the battery to generate a light rescue signal, and a movement sensitive electrical switch for intermittently turning on and off the light source in response to the body being moved by water, back-and-forth, about the neutral position. The device is a lantern incorporating a second light source for lantern light operation.

20 Claims, 2 Drawing Sheets

COMBINED LANTERN AND INTERMITTENT SIGNALLING LIGHT DEVICE

The present invention relates to a rescue signalling device for operation while floating in water.

SUMMARY OF THE INVENTION

According to the invention, there is provided a rescue signalling device comprising a waterproof buoyant body having a front end and a rear end including a compartment for accommodating a battery to provide a centre of gravity for the body to float in water in a substantially upright neutral position with the front end pointing upwards, a first light source provided within the body front end for energization by the battery to generate a light rescue signal, and a movement sensitive electrical switch for intermittently turning on and off the light source in response to the body being moved by the water back-and-forth about the neutral position, said device being in the form of a lantern incorporating a second light source for normal lighting operation.

Preferably, the body includes a side handle for carrying during normal lighting operation to have its front end pointing generally forwards.

Preferably, the body includes inner and outer transparent screw-threaded covers closing the front end.

In a preferred embodiment, the electrical switch has a fixed contact and a moving contact for coming into intermittent contact with the fixed contact in response to the movement of the body by the water.

More preferably, the electrical switch includes an electrically conducting flexible member having a free end supporting or acting as the moving contact.

It is preferred that the fixed contact extends around the moving contact.

In another preferred embodiment, the electrical switch is in the form of a mercury switch.

More preferably, the mercury switch has an envelope, two fixed terminals and mercury contained in the envelope for making and breaking electrical connection between the terminals intermittently in response to the movement of the body by the water, said envelope having a relatively lower part for keeping the mercury away from the terminals when the body remains stationary in the neutral position.

It is preferred that the second light source is provided with a cup reflector for light reflection from the body front end, and the electrical switch is provided in the space immediately behind one side of the reflector.

Preferably, the second light source is provided with a cup reflector for light reflection from the body front end, and the first light source is positioned within the reflector for light reflection from the body front end as well as outside the reflector for being visible on the side of the body.

Preferably, the first light source is provided by a light emitting diode.

It is preferred that the second light source is a light bulb controlled by another electrical switch, said two electrical switches being in independent operation.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
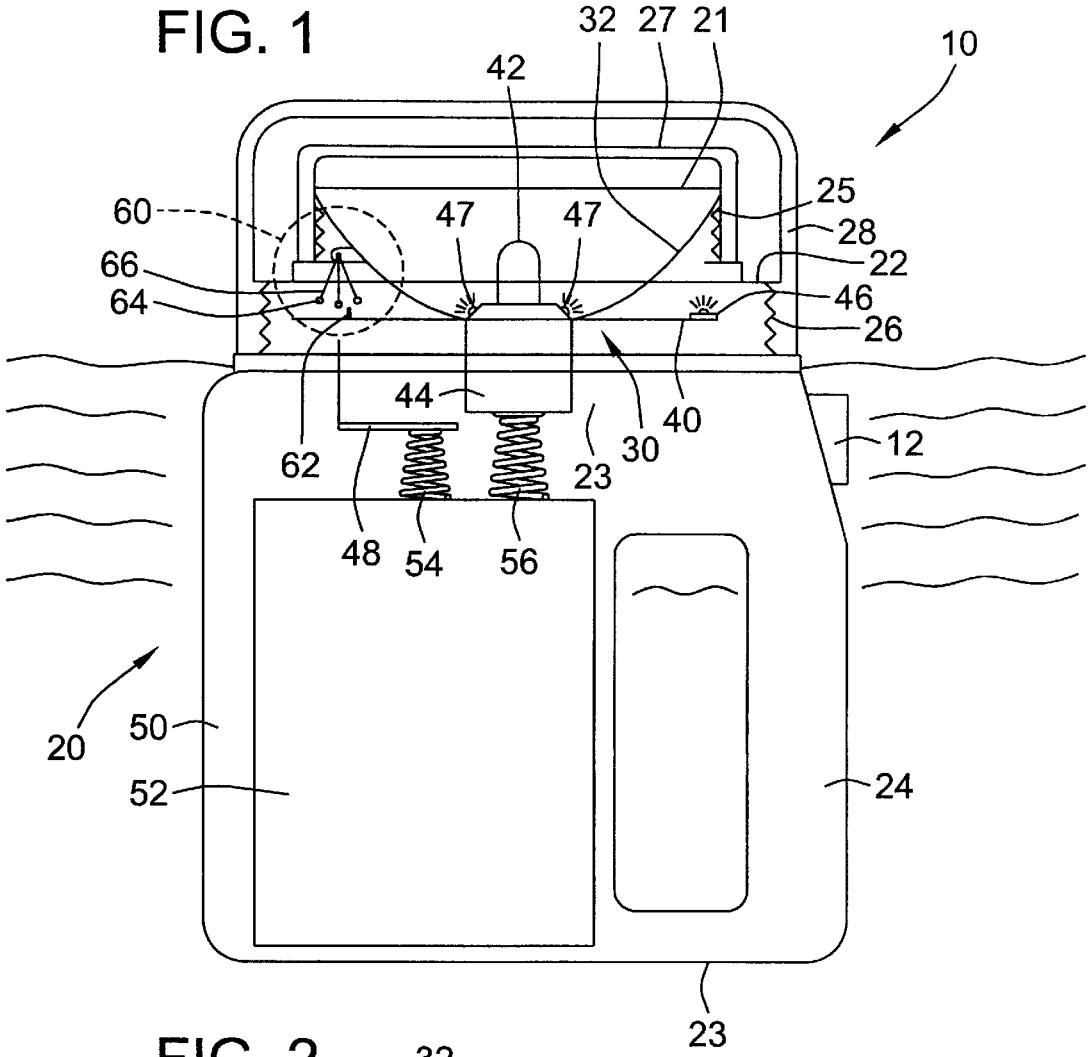
FIG. 1 is a cross-sectional side view of an embodiment of a rescue signalling device, for use floating in water, in accordance with the invention, said device incorporating a movement-sensitive electrical switch.

Referring initially to FIG. 1 of the drawings, there is shown a rescue signalling device embodying the invention, which is in the form of a lantern 10 comprising a elongate waterproof buoyant plastic body 20 having a circular open front end 21, a flat closed rear end 23 and an integral loop-shaped side handle 24, and including a lighting assembly 30 disposed within the body front end 21. The body 20 has an annular shoulder 22 near the front end 21 which divides transversely the body 20 into an outer rim 25 and an inner rim portion 26.

The rim 25 is relatively smaller than the rim portion 26, both of which are formed with external screw threads for closing (and are closed) by respective outer and inner transparent screw-threaded hoods 27 and 28 (with the use of suitable O-rings not shown). The hoods 27 and 28 are cylindrical covers which together act as a double closure for sealing the body 20 to be completely waterproof against any ingress of water.

The lighting assembly 30 is formed by a central light bulb 42 supported on a socket 44 and a parabolic cup reflector 32 disposed around the light bulb 42 for light reflection from the body front end 21. The assembly 30 includes an electrically conducting plate 40 (a plate formed with electrically conducting elements such as a printed circuit board) which is fixed around the socket 44. The plate 40 extends across the interior of the body 20 to define a compartment 50 on the opposite side (facing the body rear end 23) for accommodating a battery pack 52.

A plurality of peripheral LEDs (light emitting diodes) 46 are provided at the edges of the plate 40, surrounding the reflector 32. At least the part of the side wall of the body 20 adjacent the LEDs 46 is translucent (or transparent) such that the light of the LEDs 46 is visible from outside the body 20 on one side (through the wall). A plurality of near-centre LEDs 47 are provided around the open end of the socket 44. The LEDs 47 are close to the light bulb 42 such that the light of either the light bulb 42 or the LEDs 47 is reflectable outwards (from the body front end 21) by the reflector 32.

The two sets of LEDs 46 and 47 are positioned within as well as outside the reflector 32 for being noticeable in two directions.

The plate 40 is connected with a conductor 48 which acts as one terminal for obtaining power from the battery pack 52 to energise the light bulb 42 or the LEDs 46 and 47. The other terminal for the plate 40 is connected via the socket 44, and the socket 44 is in contact with another conductor 49. Both conductors 48 and 49 are provided on the side of the plate 40 facing the battery pack 52. The battery pack 52 has a pair of coil terminals 54 and 56 for contact with the conductors 48 and 49 separately.

The lantern 10 incorporates an external electrical push-button switch 12 connected in the circuit of the light bulb 42 and the battery pack 52, for turning on and off the light bulb 42 for normal lighting operation. An internal movement sensitive electrical switch 60 is included in the circuit of the LEDs 46 and 47 and the battery pack 52, which is provided in the space between the reflector 32 and the plate 40, at a position immediately behind one side of the reflector 32.

The switch 60 is implemented by a fixed contact in the form of a short spring coil 62 upstanding from the plate 40 and a moving contact in the form a metal bead or ball 64 connected to the outer side of the reflector 32 by means of an electrically conducting chain, wire or string 66. The string 66 is sufficiently long to allow the metal ball 64 to swing into contact with the spring coil 62. When the lantern 10 is in the upright position (as shown) and remains stationary while standing on the body rear end 23, the metal ball 64 dangles freely down to a lowermost position off to one side of the spring coil 62.

The lantern 10 is intended to function as a rescue signalling device when it is dropped into the sea and floating in the water, for example, in the case of a marine accident. While floating in the water, the lantern 10 automatically assumes the upright position (as shown), as a neutral position, by reason of the battery pack 52 acting conveniently as a relatively heavy weight providing a centre of gravity near the bottom (the body rear end 23). The lantern 10 will be rocked by the waves to swing back-and-forth about the neutral position, like a pendulum. Such a movement results in the switch 60 being momentarily and intermittently closed and opened, with the metal ball 64 swinging past and hitting the spring coil 62, thereby causing the LEDs 46 and 47 to blink or flash. A rescue or emergency signal is thus provided by the LEDs 46 and 47, flashing for drawing attention as well as for power saving.

In order for the lantern 10 to be always ready to function as a rescue signalling device, the movement sensitive switch 60 operates independently of the main switch 12 controlling the light bulb 42.

Figure 2:
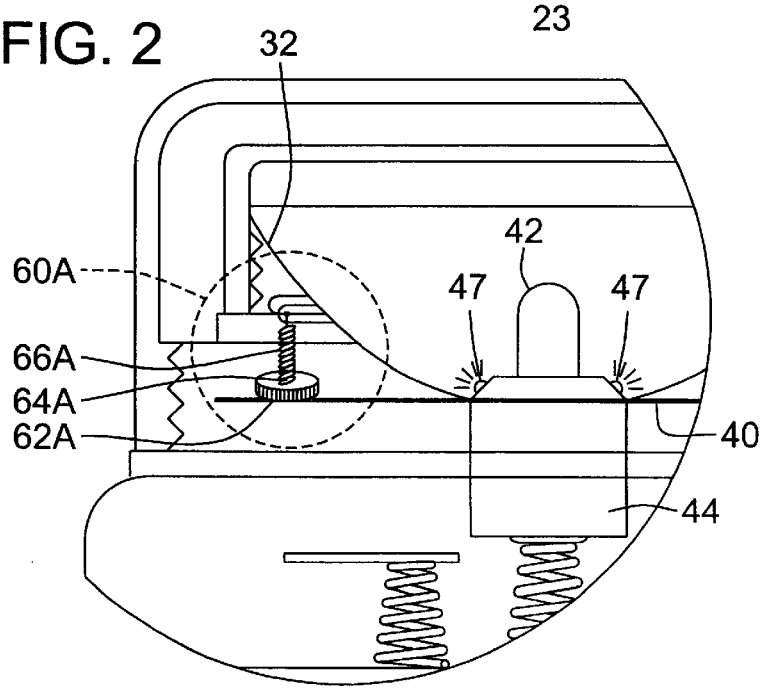
FIG. 2 is a fragmentary cross-sectional side view of the rescue signalling device of FIG. 1, incorporating a first alternative movement-sensitive electrical switch.

FIG. 2 shows the use of a first alternative movement-sensitive switch 60A to the switch 60. This switch 60A is implemented by a fixed contact in the form of a cup or collar 62A on the plate 40 and a moving contact provided by a free end 64A of a weak spring coil 66A connected at the other end to the outer side of the reflector 32. The spring coil 66A has its free end 64A normally extending to reach the centre of the collar 62A and is sufficiently long to allow, upon flexing in any direction, the free end 64A to swing into intermittent contact with the collar 62A for flashing the LEDs 46 and 47. As the collar 62A completely surrounds the coil end 64A, the switch 60A is responsive to the movement of the lantern 10 by the sea in all lateral directions. The coil end 64A may be loaded with a weight or have denser turns for greater sensitivity to movement.

Figure 3:
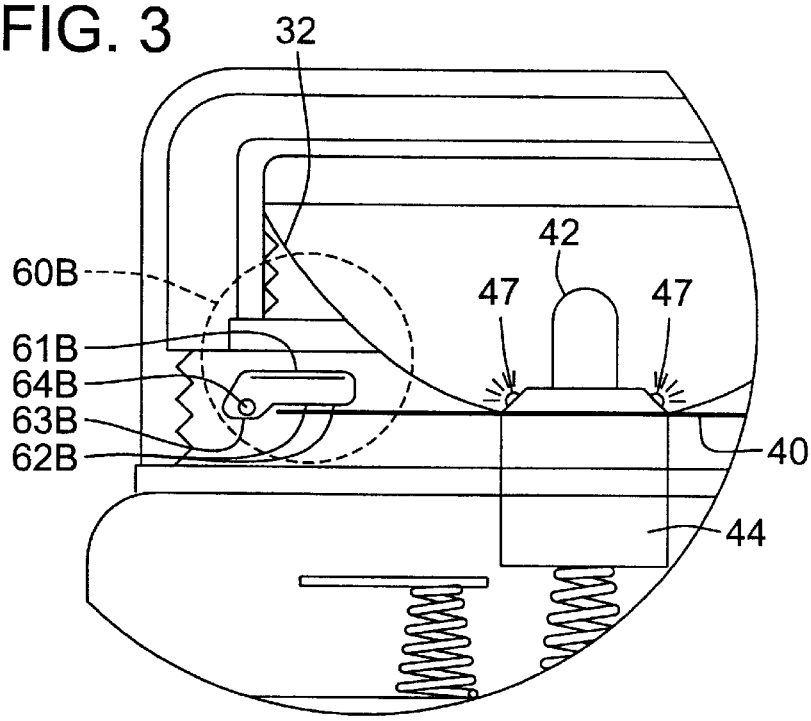
FIG. 3 is a fragmentary cross-sectional side view of the rescue signalling device of FIG. 1, incorporating a second alternative movement-sensitive electrical switch.

FIG. 3 shows the use of a second alternative movement-sensitive switch 60B to the switch 60. This switch 60B is in the form of a mercury switch supported on the plate 40, which has an oblong glass envelope 61B, two terminals 62B connected to the LEDs 46 and 47, and a mercury pellet or drop 64B in the envelope 61B. The mercury drop 64B is free to flow back-and-forth along the envelope 61B to make and break intermittently electrical connection between the two terminals 62B, For flashing the LEDs 46 and 47. The envelope 61B has a slightly lower end 63B for keeping the mercury drop 64B away from the terminals 62B, when the lantern 10 is standing upright on the body rear end 23.

It is perceived that an electrically conducting metal bead or ball may be used, instead of the mercury drop 64B, as the switching member provided that it can make and break the connection between the two terminals 62B suitably modified.

Figure 4:
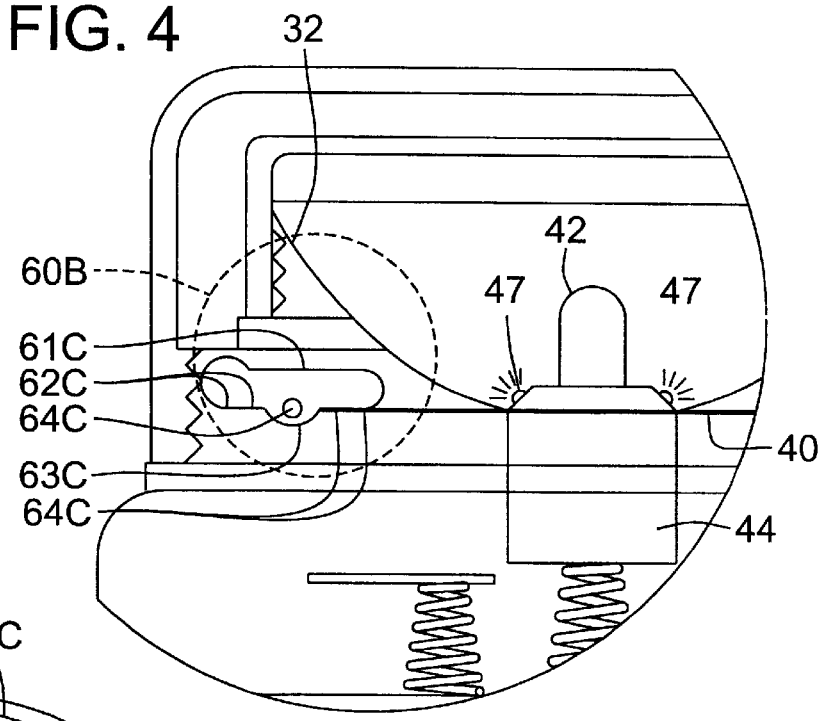
FIG. 4 is a fragmentary cross-sectional side view of the rescue signalling device of FIG. 1, incorporating a third alternative movement-sensitive electrical switch.
Figure 5:
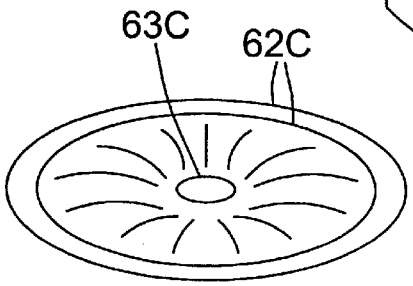
FIG. 5 is an enlarged perspective view of part of the electrical switch of FIG. 4.

FIGS. 4 and 5 show the use of a third alternative movement-sensitive switch 60C to the switch 60. This switch 60C is likewise a mercury switch having a dish-like glass envelope 61C, two concentric ring terminals 62C of slightly different diameters, and a mercury drop 64C in the envelope 61C. The mercury drop 64C is free to flow in any direction around in the envelope 61C to make and break intermittently electrical connection between the two terminals 62C, for flashing the LEDs 46 and 47. The envelope 61C has a central recess 63C for keeping the mercury drop 64C away from the terminals 62C when the lantern 10 is standing upright on the body rear end 23.

During normal lighting operation, the lantern 10 is usually carried by the handle 24 to have its body front end 21 pointing generally forwards, lying down (horizontally) and only on rare occasions vertically upwards. The switches 60, 60A, 60B and 60C are constructed to minimise the chance of turning on the LEDs 46 and 47 during normal lighting operation. For the switch 60/60A, the moving contact 64/64A will swing off or out of the fixed contact 62/62A. For the switch 60B/60C, the mercury drop 64B/64C will move away from the terminals 62B/62C.

The invention has been given by way of example only, and various other modifications of and/or alterations to the described embodiments may be made by persons skilled in the art without departing from the scope of the invention as specified in the appended claims.

What is claimed is:

1. A rescue signalling device comprising a waterproof buoyant body having a front end and a rear end, including a compartment for accommodating a battery to provide a centre of gravity for the body to float in water in a substantially upright neutral position with the front end pointing upwards, a first light source within the body front end for energization by the battery to generate a light rescue signal, a movement sensitive electrical switch for intermittently turning on and off the first light source in response to the body being moved back-and-forth about the neutral position, and a second light source for a lighting operation as a lantern.

2. The rescue signalling device as claimed in claim 1, wherein the body includes a side handle for carrying during lighting operation as a lantern with the front end pointing generally horizontally.

3. The rescue signalling device as claimed in claim 1, wherein the body includes inner and outer transparent screw-threaded covers closing the front end.

4. The rescue signalling device as claimed in claim 1, wherein the electrical switch has a fixed contact and a moving contact for intermittently contacting the fixed contact in response to the movement of the body.

5. The rescue signalling device as claimed in claim 4, wherein the electrical switch includes an electrically conducting flexible member having a free end supporting or acting as the moving contact.

6. The rescue signalling device as claimed in claim 4, wherein the fixed contact extends around the moving contact.

7. The rescue signalling device as claimed in claim 1, wherein the electrical switch is of a mercury switch.

8. The rescue signalling device as claimed in claim 7, wherein the mercury switch has an envelope, two fixed terminals and mercury contained in the envelope for making and breaking electrical connection between the terminals intermittently in response to the movement of the body, the envelope having a lower part for keeping the mercury away from the terminals when the body remains stationary in a neutral position.

9. The rescue signalling device as claimed in claim 1, wherein the second light source includes a cup reflector for reflecting light out the front end, and the electrical switch is located immediately behind a side of the reflector.

10. The rescue signalling device as claimed in claim 1, wherein the second light source includes a cup reflector for reflecting light out the front end, and the first light source is positioned within the reflector for directing light out the front end as well as outside the reflector for being visible on a side of the body.

11. The rescue signalling device as claimed in claim 1, wherein the first light source includes a light emitting diode.

12. The rescue signalling device as claimed in claim 1, including a second electrical switch wherein the second light source is a light bulb controlled by the second electrical switch, the second electrical switch being independent in operation from the electrical switch.

13. The rescue signalling device as claimed in claim 5, wherein the fixed contact extends around the moving contact.

14. A combination lantern and signalling device comprising:

a waterproof buoyant body having a front end and a rear end, including a compartment for accommodating a battery to provide a centre of gravity for the body to float in water in a substantially upright neutral position with the front end pointing upwards, a first light source within the front end of the body for energization by the battery for generating a light signal, a movement sensitive electrical switch for intermittently connecting the first light source to the battery in response to back-and-forth movement of the body about the neutral position, a second light source within the body front end for energization by the battery to generate a continuous lantern light, and an on-off electrical switch for connecting the battery to the second light source to produce the continuous lantern light whereby the first and second light sources are independently connected to the battery.

15. The rescue signalling device as claimed in claim 14, wherein the body includes a side handle for carrying during lighting operation as a lantern with the front end pointing generally horizontally.

16. The combination lantern and signalling device and claimed in claim 14, wherein the movement sensitive electrical switch has a fixed contact and a moving contact intermittently contacting the fixed contact in response to the back-and-forth movement of the body about the neutral position.

17. The combination lantern and signalling device and claimed in claim 16, wherein the movement sensitive electrical switch includes an electrically conducting flexible member having a free end as the movable contact.

18. The combination lantern and signalling device and claimed in claim 14, wherein the movement sensitive electrical switch is a mercury switch.

19. The combination lantern and signalling device and claimed in claim 14 including a cup reflector reflecting light produced by the second light source toward the front end of the body wherein the on-off electrical switch is located on the body between the reflector and the rear end of the body.

20. The combination lantern and signalling device and claimed in claim 14, wherein the first light source includes at least one light emitting diode and the second light source includes a light bulb.

* * * * *